United States Patent [19]

Webinger

[11] 4,191,323

[45] Mar. 4, 1980

[54] CARTON BLANK AND ERECTED INTEGRAL CARTON AND COVER

[75] Inventor: George P. Webinger, Minneapolis, Minn.

[73] Assignee: Champion International Corporation, Stamford, Conn.

[21] Appl. No.: 972,271

[22] Filed: Dec. 22, 1978

[51] Int. Cl.[2] ..... B65D 3/02

[52] U.S. Cl. ..... 229/8; 225/44 R

[58] Field of Search ..... 229/8, 44

[56] References Cited

U.S. PATENT DOCUMENTS

| | | | |
|---|---|---|---|
| 2,050,894 | 8/1936 | Paige | 229/8 X |
| 2,119,382 | 5/1938 | Cooper | 229/8 X |
| 2,990,097 | 6/1961 | Thompson | 229/44 R X |
| 3,078,989 | 2/1963 | Curran et al. | 229/8 UX |
| 3,610,514 | 10/1971 | Samsing | 229/8 X |
| 3,979,044 | 9/1976 | Tani | 229/44 R X |

*Primary Examiner*—Davis T. Moorhead

*Attorney, Agent, or Firm*—Evelyn M. Sommer

[57] ABSTRACT

A carton is erected from a cardboard one-piece blank having a connected series of five central elongated panels and four pairs of side flaps, with the blank being erected to form a tray to receive a product before being folded and closed. In one embodiment certain elongated panels have concave or convex fold lines and the panels are proportioned to form a carton having a sculptured and tapered appearance.

21 Claims, 3 Drawing Figures

CARTON BLANK AND ERECTED INTEGRAL CARTON AND COVER

BACKGROUND OF THE INVENTION

The present invention relates to cartons and more particularly to a paperboard blank and an erected and glued carton made from the blank.

There have been many designs proposed for various types of paperboard cartons, some of which have been patented. However, in the art of paperboard cartons there are always new challenges to produce suitable cartons for newly developed products and for products already on the market. Such cartons should be economical to produce, protect the product, and provide an interesting and perhaps unusual visual display. The problem of producing a satisfactory carton is particularly acute where it is desired that the carton have one or more lines of curvature in order to enhance its appearance or for functional purposes.

SUMMARY OF THE INVENTION

In accordance with the present invention a paperboard one-piece integral carton blank may be erected and glued to form a carton having a sculptured, and preferably a tapered, appearance. The paperboard blank consists of a series of panels and side flaps which are connected by fold lines. Generally the panels are elongated, although such elongation is not a necessary part of the present invention.

The panels include a side panel having a free concave edge, a base panel which is rectangular and forms the base of the carton, a rectangular panel which forms the back of the carton, a convex top panel which forms the top of the panel and which has a convex fold line, a concave front panel whose concave fold line is the same as the convex fold line of the convex top panel, and a folded-back panel which provides a smooth edge on the concave front panel.

A series of side flaps are provided in order to glue the carton and maintain it in its erected position. Such side flaps are located on opposite sides of each of the base panel, the rectangular panel, the convex top panel and the concave front panel—for the total of four pairs of side flap panels.

Firstly the blank is formed with its fold and cut lines. Then the paperboard carton is erected into an open tray. The tray is formed by adhering together the flaps (first side flaps) of the base panel with the flaps of the rectangular panel (second side flaps) and also the flaps of the convex top panel (third side flaps) with the flaps of the concave front panel (fourth side flaps). Preferably, at this point, the product is inserted into the tray. The tray is then folded inwardly at the score line (fold line) between the rectangular panel and the convex top panel to form a carton with an integral cover.

OBJECTIVES AND FEATURES OF THE PRESENT INVENTION

It is an objective of the present invention to provide an economical carton which is formed from a one-piece integral paperboard carton blank.

It is a further objective of the present invention to provide such a carton which would provide a sculptured and curved appearance by having a curved front panel and a top cover having a line of curvature between its top panel and its front panel.

The present invention presents a carton comprising a tray which has an integral cover. An alternative to the present invention would be a tray having a separate cover glued to the tray, but that alternative is not as economical or as fine in appearance as the carton of the present invention. One pair of sidewalls (the end walls) of the carton are formed by extensions (side flaps) of the rectangular panel forming the back wall of the erected carton.

The preferred embodiment, described in detail below, shows a carton having a tapered and sculptured appearance. However, other cartons constructed according to the present invention may not be tapered, may differ in size and shape, and may differ in appearance from that embodiment.

It is a feature of the invention to provide a carton blank comprising a series of panels and side flaps as integral portions of the paperboard blank, and a carton erected and glued from that blank. The blank includes a base rectangular panel, forming the carton base, having opposite fold line edges with dimensions in length of $L_1$ and width of $W_1$ and having a first pair of side flap panels, each first side flap panel being joined at a fold line to an opposite width side of the base panel. A rectangular panel is joined to the base panel along a fold line and has opposite fold line edges with length $L_2$ equal to length $L_1$ and width $W_2$. The rectangular panel becomes the back panel of the erected carton and has a second pair of flap panels, each second flap panel being joined at a fold line to an opposite width side of the rectangular panel. A concave side four-sided panel has its inner edge joined at a fold line to the base panel along its length and has an opposite free edge in the form of a concave curve. A convex top four-sided panel, which becomes the top of the carton, has its inner edge joined at a fold line to the rectangular panel along its length and has an opposite non-free edge in a convex curve. The convex top panel has a third pair of side flap panels, each third side flap panel being joined at a fold line to an opposite width side of the convex top panel. A concave front four-sided panel has a concave curved edge joined to the convex curved edge of said convex top panel and has a fourth pair of side flap panels, each fourth side flap panel being joined at a fold line to an opposite width side of the concave front panel.

BRIEF DESCRIPTION OF THE DRAWINGS

Other objectives of the present invention will be apparent from the detailed description, provided below, of the inventor's best mode of practicing the invention. The description provided below should be taken in conjunction with the accompanying drawings, in which.

DETAILED DESCRIPTION OF THE INVENTION

Figure 1:
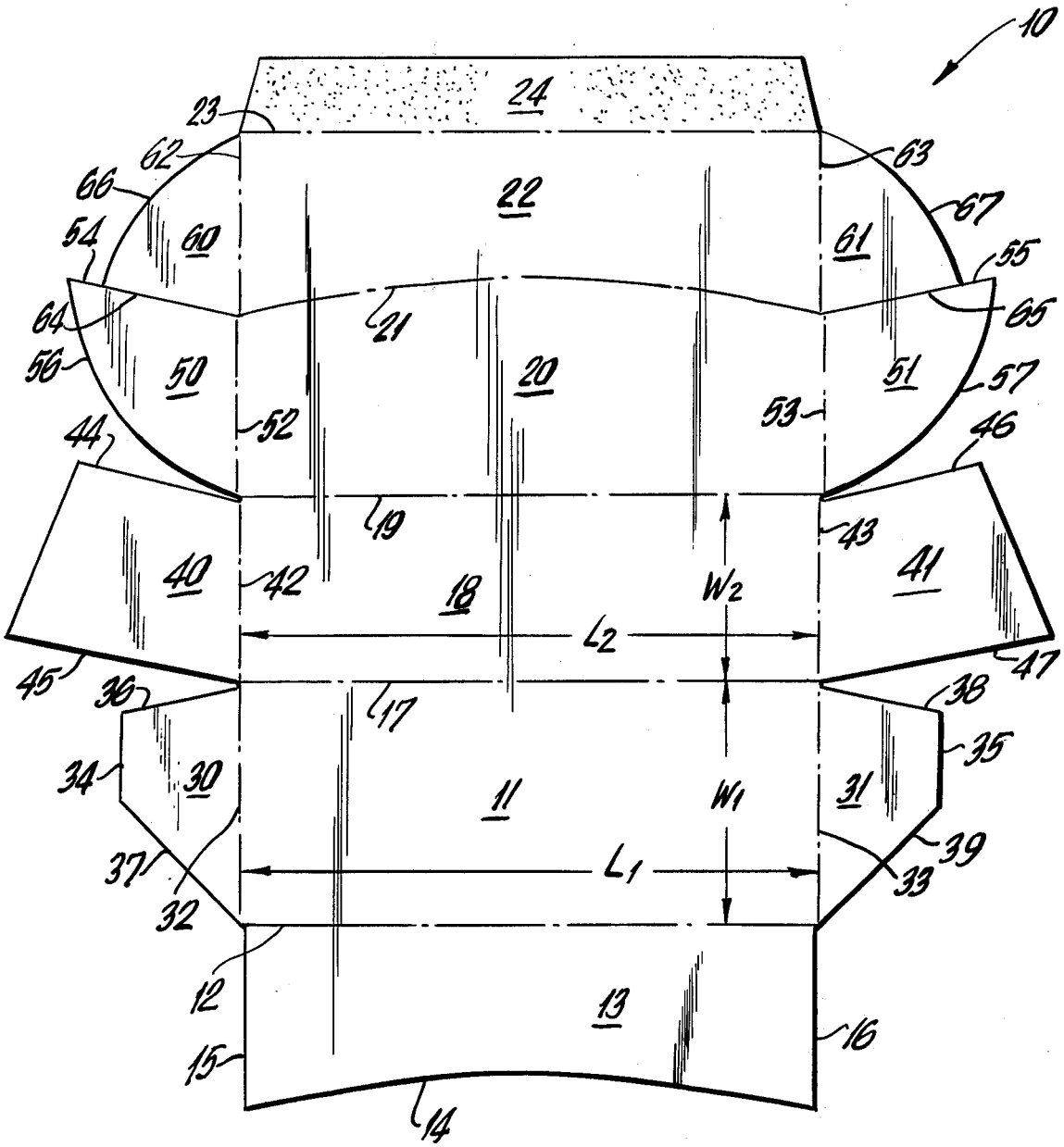
FIG. 1 is a top plan view of the paperboard blank of the present invention.

The blank of the present invention, made of paperboard or other suitable material, is shown in FIG. 1. As shown, the paperboard blank 10 includes a rectangular base panel 11 which becomes the base of the carton to be erected from the blank 10. The base panel 11 has length $L_1$ and width $W_1$. A fold line 12 joins the base panel 11 to the concave side panel 13. The concave side panel 13 has a concave free edge 14 and opposite side free edges 15 and 16. The concave side panel 13 becomes the freestanding front panel of the erected carton.

The base panel 11 is joined by fold line 17 to a rectangular panel 18 having a length $L_2$, which is equal to the length $L_1$, of the base panel 11 and a width $W_2$. The rectangular panel 18 becomes the back panel of the erected carton. The rectangular panel 18 is joined by straight fold line 19 to a convex top panel 20 which becomes the top of the erected carton. The convex top panel has, in addition to its straight fold line 19, a convex fold line 21 which joins it to the concave front panel 22. The convex fold line 21 is the concave fold line for the front panel 22. The concave front panel 22 has a straight fold line 23, parallel to the fold line 19, which joins panel 22 to a fold back panel 24. The fold back panel 24 is adapted to fold back 360° so that the fold back panel 24 becomes glued to the concave front panel 22 to provide a rounded free edge along the fold line 23.

A set of side flaps are provided so that the erected carton may be glued together. For this purpose the first pair of side flaps 30,31 are connected by respective fold lines 32,33 to the base panel 11. Each of the flaps 30 and 31 has a free edge, respectively 34,35, which is about parallel to the fold lines 32,33 respectively. In addition, each of the side flaps has a pair of free edges, respectively edges 36,37 and 38,39 which, if extended, would meet at an acute angle.

The second pair of side flaps 40,41 is connected along respective fold lines 42,43 to the rectangular panel 18. Each of the flaps 40 and 41 has opposite free edges 44,45 and 46,47, respectively, which are parallel.

A third pair of side flaps 50,51 is joined by the respective fold lines 52,53 to the convex top panel 20. The respective flaps 50,51 have outwardly disposed angular free edges 54,55 and free edges 56,57 in the form of convex curves.

The fourth pair of side flaps 60,61 are connected along fold lines 62,63, respectively, to the concave front panel 22. The side panels 60,61 have respective free edges 64,65 which are severed along the same lines as the free edges 54,55. In addition, the side flaps 60,61 have convex free edges 66,67.

To erect the carton, one first forms an open tray by (i) gluing side flap 41 to side flap 31 and also gluing side flap 40 to side flap 30; and (ii) gluing the flap 61 to flap 51 and similarly gluing flap 60 to flap 50. The score line 19 separates the two sides of the open tray, shown in FIG. 2. The product may then be inserted into the tray, the tray having as its base the base panel 11 and the rectangular panel 18. The product may be inserted, for example, by placing the tray on its side.

Figure 2:
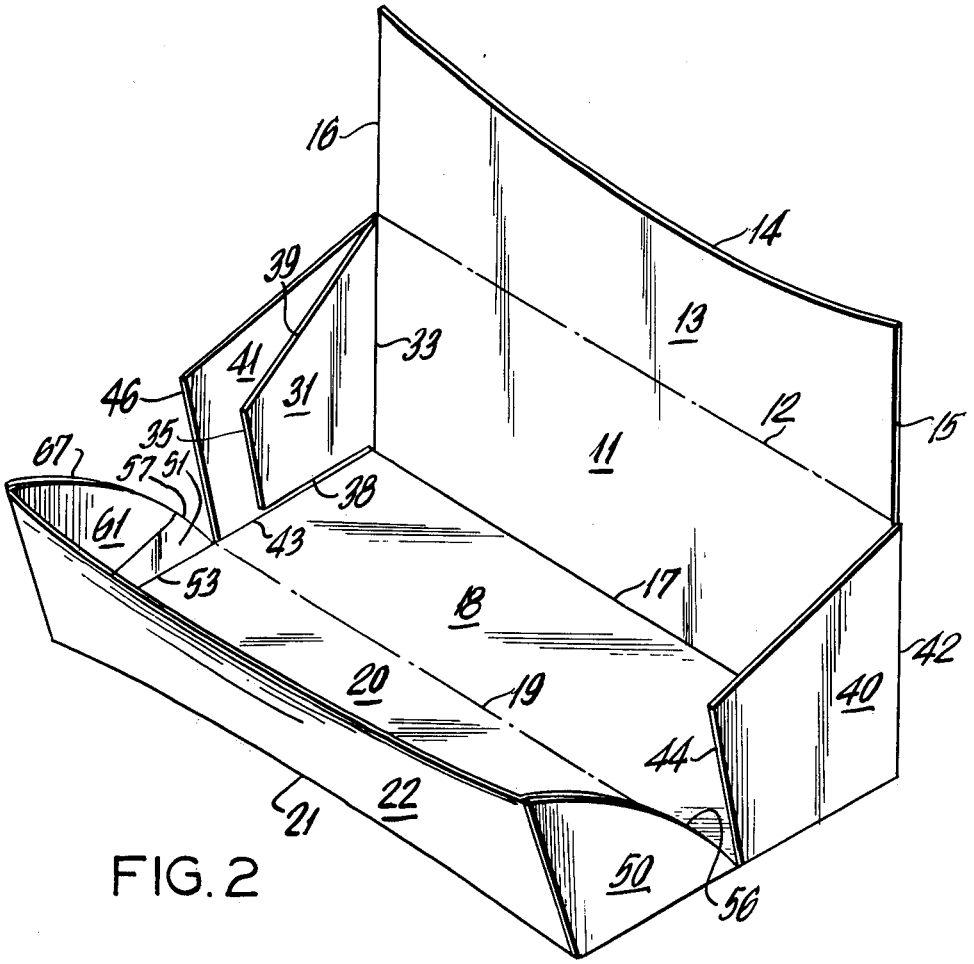
FIG. 2 is a perspective view of the tray which forms the carton of the present invention.

In the next step the concave side panel, which is an extended flap, is folded over, along the fold line 12, so that its angle is about the same as the side walls formed by the flaps 40,41. In other words, concave side panel 13 is folded so that its edges 15,16 are closed to the free edges of side flaps 40,41. In the final step the tray of FIG. 2 is folded inwardly along fold line 19 telescoping together to form the carton shown in FIG. 3.

Figure 3:
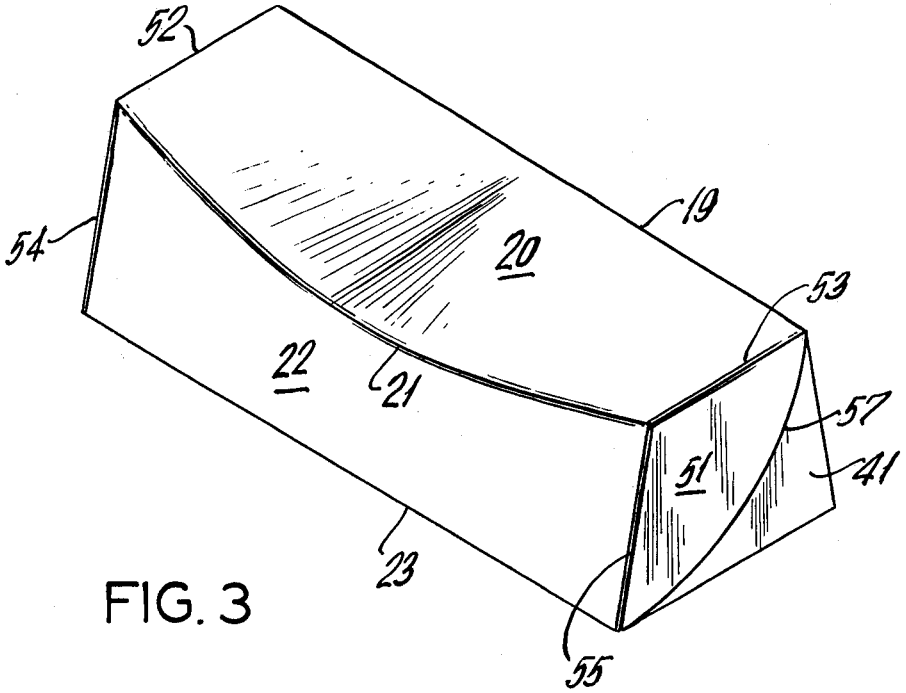
FIG. 3 is a perspective view of the carton of the present invention with its cover closed.

The finishhed carton, shown in FIG. 3, presents a tapered and sculptured appearance. Alternatively, by altering the sizes and dimensions, the carton need not be tapered or present the sculptured appearance of the carton of FIG. 3.

What is claimed is:

1. A carton blank comprising as integral portions of a paperboard blank:

(a) a base rectangular panel (11) having opposite fold line edges with dimensions in length of $L_1$ (12,17) and width of $W_1$ (32,33);

(b) a first pair of side flap panels (30,31) each first side flap panel being joined at a fold line (32,33) to an opposite width side of said base panel (11);

(c) a rectangular panel (18) joined to the base panel (11) along a fold line (17) and having opposite fold line edges with length $L_2$ (17,19) equal to length $L_1$ and with width $W_2$ (42,43);

(d) a second air of flap panels (40,41) each second flap panel being joined at a fold line (42,43) to an opposite width side of said rectangular panel (18);

(e) a concave edge four-sided panel (13) having its inner edge (12) joined at a fold line to said base panel (11) along its length and having an opposite free edge (14) in the form of a concave curve;

(f) a convex top four-sided panel (20) having its inner edge (19) joined at a fold line to the said rectangular panel (20) along its length and having an opposite non-free edge (21) which is a convex curve;

(g) a third pair of side flap panels (50,51) with each of said third pair of side flap panels being joined at a fold line (52,53) to an opposite side of said convex top panel (20);

(h) a concave four-sided front panel (22) having a concave curved edge (21) which is the said convex curved edge of said convex top panel; and (i) a fourth pair of side flap panels (60,61) with each side flap panel being joined at a fold line (62,63) to an opposite width side of said concave front panel (22).

2. A carton blank as in claim 1 wherein the width $W_1$ of the base panel is greater than the width $W_2$ of the rectangular panel.

3. A carton blank as in claim 1 wherein said concave side panel (13) has opposite free width edges (15,16) which width edges are parallel with imaginary extensions of the opposite width fold lines $W_1$ (32,33).

4. A carton blank as in claim 1 wherein the rectangular panel side flaps (40,41) each have two opposite free edges (44,45 and 46,47) parallel to each other and a free edge which, if extended, would form an acute angle with the joined edge (42,43) if also imaginatively extended.

5. A carton blank as in claim 1 wherein the third pair of side flaps (50,51) each has a straight free edge (54,55) severed at a line which is a straight free edge of a fourth side flap (60,61).

6. A carton blank as in claim 5 wherein each of the said third side flaps (50,51) has a free convex curved edge (56,57).

7. A carton blank as in claim 5 wherein each of said four pairs of side flaps (60,61) has a convex free edge (66,67).

8. A carton blank as in claim 1 wherein each of said first pair of side flaps (30,31) has a free edge (34,35) which is parallel to its edge joined to said base panel.

9. A carton blank as in claim 1 wherein each of said first pair of side flaps (30,31) has opposite free edges (36,37 and 38,39) which, if extended, would form an acute angle.

10. A carton blank as in claim 1 and further comprising a fold back panel (24) joined along a straight fold line (23) to the length of said concave front panel (22).

11. A carton blank as in claim 10 wherein said fold back panel (24) has a free edge parallel to its said fold line (23) with said convex top panel (22).

12. A carton formed from a single integral paperboard blank, said carton comprising:

(a) a base rectangular panel having opposite fold line edges with dimensions in length of $L_1$ and width of $W_1$;

(b) a first pair of side flap panels, each first side flap panel being joined at a fold line to an opposite width side of said base panel;

(c) a rectangular back panel joined to the base panel along a fold line and having opposite fold line edges with length $L_2$ equal to length $L_1$ and with width $W_2$;

(d) a second pair of flap panels, each second flap panel being joined at a fold line to an opposite width side of said rectangular back panel and having one of its faces fixed to a face of one of said first side flap panels;

(e) a concave side four-sided panel having its inner edge joined at a fold line to said base panel along its length and having an opposite free edge in the form of a concave curve;

(f) a convex top cover four-sided panel having its inner edge joined at a fold line to the said rectangular panel along its length and having an opposite non-free edge being a convex curve;

(g) a third pair of side flap panels, each third side flap panel being joined at a fold line to an opposite width side of said convex top panel;

(h) a concave front cover four-sided panel having a concave curved edge joined to the said convex curved edge of said convex top panel; and (i) a fourth pair of side flap panels, each fourth side flap panel being joined at a fold line to an opposite width side of said concave front panel and having one of its faces fixed to a face of said third pair of side flap panels.

13. A carton as in claim 12 wherein the width $W_1$ of the base panel is greater than the width $W_2$ of the rectangular panel.

14. A carton as in claim 12 wherein said concave side panel has opposite free and unjoined width edges which width edges are parallel with imaginary extensions of the opposite width fold lines $W_1$.

15. A carton as in claim 12 wherein the rectangular panel side flaps each have two opposite free edges parallel to each other and a free edge which, if imaginatively extended, would form an acute angle with the joined edge, if also imaginatively extended.

16. A carton as in claim 12 wherein each of the said third side flaps has a free convex curved edge.

17. A carton as in claim 12 wherein each of said fourth pair of side flaps has a convex free edge.

18. A carton as in claim 12 wherein each of said first pair of side flaps has a free edge which is parallel to its edge joined to said base panel.

19. A carton as in claim 12 wherein each of said first pair of side flaps has opposite free edges which, if imaginatively extended, would form an acute angle.

20. A carton as in claim 12 and further comprising a fold back panel joined and folded back along a straight fold line the length of said concave front panel and fixed to said concave front panel.

21. A carton as in claim 20 wherein said fold back panel has a free edge parallel to its said fold line with said convex top panel.

* * * * *